United States Patent [19]

Vrijssen

[11] Patent Number: 4,713,879

[45] Date of Patent: Dec. 22, 1987

[54] METHOD OF MANUFACTURING A DEVICE HAVING AN ELECTRIC RESISTANCE LAYER AND THE USE OF THE METHOD

[75] Inventor: Gerardus A. H. M. Vrijssen, Eindhoven, Netherlands

[73] Assignee: U.S. Philips Corporation, New York, N.Y.

[21] Appl. No.: 843,329

[22] Filed: Mar. 24, 1986

[30] Foreign Application Priority Data

Mar. 28, 1985 [NL] Netherlands ..... 8500905

[51] Int. Cl.[4] ..... B05D 5/12

[52] U.S. Cl. ..... 29/620; 445/36; 313/450; 427/126.2; 427/126.5; 427/101

[58] Field of Search ..... 338/258; 29/611, 620; 313/450, 479; 427/101, 126.2, 126.5; 445/36

[56] References Cited

U.S. PATENT DOCUMENTS

| | | | |
|---|---|---|---|
| 1,835,582 | 12/1931 | Allen | 338/258 |
| 3,375,390 | 3/1968 | Schlesinger | 313/450 |
| 3,758,802 | 9/1973 | Kubo et al. | 313/479 |
| 3,773,555 | 11/1973 | Cotton et al. | 427/126.5 X |
| 3,909,655 | 9/1975 | Grimmett et al. | 313/450 |
| 4,130,671 | 12/1978 | Nagesh et al. | 252/518 X |
| 4,366,042 | 12/1982 | Caldwell et al. | 427/126.5 X |
| 4,561,996 | 12/1985 | Holmes et al. | 427/126.5 |

*Primary Examiner*—Kenneth J. Ramsey

*Attorney, Agent, or Firm*—Norman N. Spain

[57] ABSTRACT

The invention relates to a method of manufacturing a device in which a homogeneous electrical resistance layer of a resistive material having 10 ohm.cm is formed on an insulating substrate. According to the invention a stable binder-free suspension containing ruthenium hydroxide and glass particles is provided on the insulating substrate from which a ruthenium oxide-containing electrical resistance layer is formed by heating. The method according to the invention may be used successfully, for example, in the manufacture of cathode ray tubes.

10 Claims, 8 Drawing Figures

Figure 1:
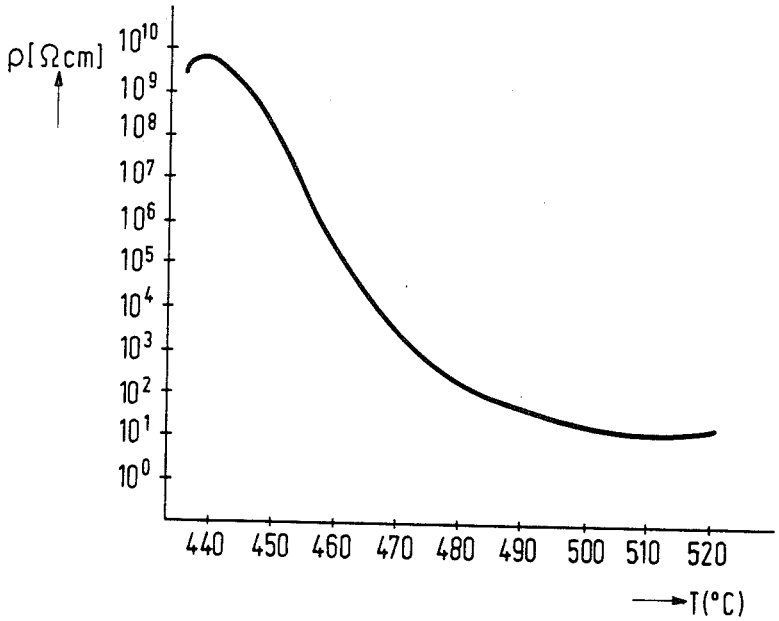

METHOD OF MANUFACTURING A DEVICE HAVING AN ELECTRIC RESISTANCE LAYER AND THE USE OF THE METHOD

The invention relates to a method of manufacturing a device in which a homogeneous electrical resistance layer of a resistive material having a resistivity of at least 10 ohm.cm is formed on an insulating substrate.

In methods of the above-mentioned type it is conventional to deposit the resistance layers from the gaseous phase, for example by sputtering or by means of a chemical reaction, on the insulating substrate.

In general it is also possible to form an electrical resistance layer on an insulating substrate starting from a suspension of a material in a liquid (see, for example, U.S. Pat. No. 3,052,573). The starting material in this case is a suspension from which a homogeneous thin layer can be provided on a substrate, for example, by silk screening, centrifuging or by means of a brush.

For that purpose, a suspension is given suitable properties by the addition to the suspension of thickening agents, emulsifiers or binders of an organic nature (hereinafter referred to as binders) which after providing on the substrate can be decomposed by a suitable thermal treatment.

A disadvantage of the use of organic additions to the suspension is that in practice it is not possible to obtain electrical resistance layers having a sufficiently high resistivity.

It has also been found that many resistive materials have a voltage-dependent, temperature-sensitive and photosensitive resistance.

One of the objects of the invention is to avoid the above-mentioned disadvantages at least to a considerable extent.

For that purpose, according to the invention, the method mentioned in the opening paragraph is characterized in that from a stable binder-free suspension containing ruthenium-hydroxide and glass particles a layer is provided in the insulating substrate from which an electrical resistance layer, which contains 1–6 percent by weight of ruthenium oxide, is formed by heating.

The invention is based inter alia on the recognition of the fact that organic addition to the suspension is not necessary to form therefrom a thin homogeneous layer on a substrate.

Homogeneous scratch-resistant and non-porous electrical resistance layers having a sufficiently high resistivity and sheet resistance can be formed in a reproducible manner on insulating substrates by means of the method according to the invention using conventional techniques.

The layer thickness of a layer thus obtained is, for example, 1–1.5 μm. Ruthenium oxide is a resistance material the resistance of which depends at most slightly on voltage, temperature and light.

A mixture of glass particles and water is preferably used as a starting material, in which mixture ruthenium hydroxide is precipitated. Particularly good powder layers are deposited on the substrate by means of a suspension obtained from such a mixture. The glass particles on which at least a part of the ruthenium hydroxide adheres are one of the causes of the formation of a closed, readily adhering layer in the subsequent heating treatment.

The deposit of ruthenium hydroxide and glass particles is preferably suspended in an alcohol to which ammonia is added. Ammonia has been found to be important for the stability of the suspension and it has been found that uniform layers can be provided in a particularly simple manner on substrates from such a suspension.

Isopropanol is preferably used as an alcohol.

The insulating substrate may be, for example, glass. During the heating in which the ultimate electrical resistance layer is formed the ruthenium hydroxide is converted into ruthenium oxide, the glass particles merge and form a layer with the rhuthenium oxide which is homogeneous as regards composition and thickness. Usual heating temperatures are, for example, in the range from 400° to 600° C. in dependence on which the resistance value can be adjusted.

Although the glass particles merge to form a homogeneous layer this does not mean that during the heating they flow over an undesirably large area. On the contrary, it has been found that after heating the dimensions given to the layer prior to heating can accurately be maintained during heating.

Therefore, in a preferred embodiment of the method in accordance with the invention, after providing the layer from the suspension on the insulating substrate and prior to the heating the layer is subjected without any objection and often advantageously to a shaping treatment.

Said shaping treatment may be of a variety of natures. For example, a photochemical technique may be used. For simplicity, a mechanical shaping treatment is advantageously used.

In view of the stability of the suspension used in the method in accordance with the invention it has proved possible to provide layers of such suspensions on a substrate in a reproducible manner. It has been found that the form of the substrate on which the layer is provided generally is not very critical.

In a preferred embodiment of the method in accordance with the invention the layer is provided from the suspension on the inside of a hollow tube as the insulating substrate.

Said suspension is preferably provided simply and economically by drawing-in the suspension into the tube up to a desired height and then draining the suspension from the tube.

Also when a layer from a suspension on a substrate is provided in such a manner a shaping treatment is still possible. For example, the non-heated layer is preferably by a mechanical shaping treatment given a helical form on the inside of the hollow tube.

In view of the very good shape of the helix after heating neither the pitch of the helix nor the distance between the turns of the helix is very critical and both may be small. The said distance between the turns may be, for example, 50 μm. The voltage which is applied over the whole length of the helix may also be very high without flash-over occurling between adjacent turns. The flash-over voltage between 2 turns at a mutual distance of 50 μm often is more than 1.5 kV.

Such a device in the form of a hollow tube manufactured by means of the method in accordance with the invention may therefore be used as a cathode ray tube, for example, a projection television display tube. Said cathode ray tube comprises a glass envelope consisting of a display window, a cone and a neck, an electron gun having at least one focussing electrode being provided in the neck.

The focussing electrode in said cathode ray tube is obtained according to the invention by using the method in accordance with the invention and it has the form of a hollow tube in which a helical resistance layer is provided. Said resistance layer serves as a voltage divider with which the desired potentials are obtained on the inside of the glass tube which are necessary for an electron lens with few aberration errors. The desired potentials can be obtained by varying the pitch, the distance between the turns and/or the resistance of the helical resistance layer. The diameter of the neck of the cathode ray tube may also be chosen to be small. For example, the resistance layer may be provided on the inside of the envelope.

In another useful application of the method in accordance with the invention a cathode ray tube is obtained which comprises a glass envelope consisting of a display window, a cone and a neck, in which an electron gun having at least one focussing electrode is provided in the neck and an anticharging layer is present on the inner wall of the neck. Said anti-charging layer is obtained by using the method according to the invention. The anti-charging layer prevents the neck from being charged to too high a potential.

High-ohmic resistors for use at voltages up to at least 40 kV can be obtained by means of the method according to the invention.

Figure 2:
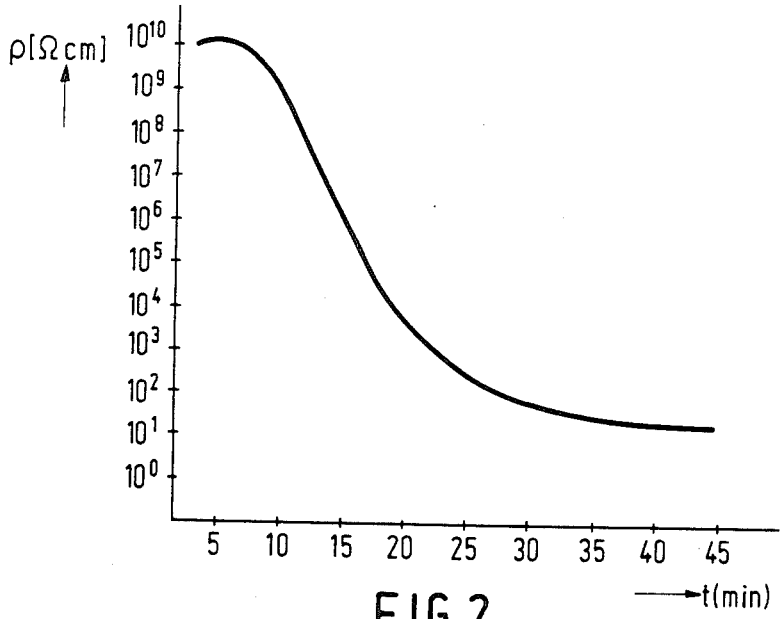
Figure 3:
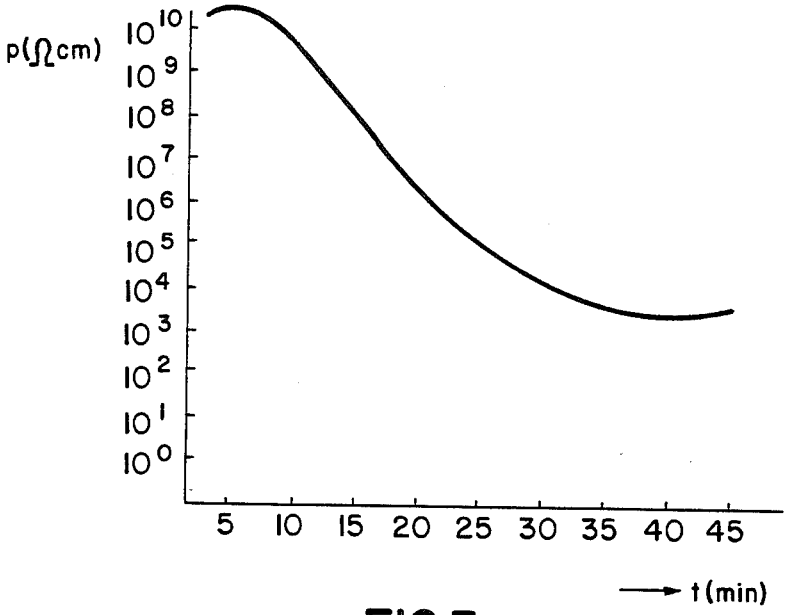
Figure 4:
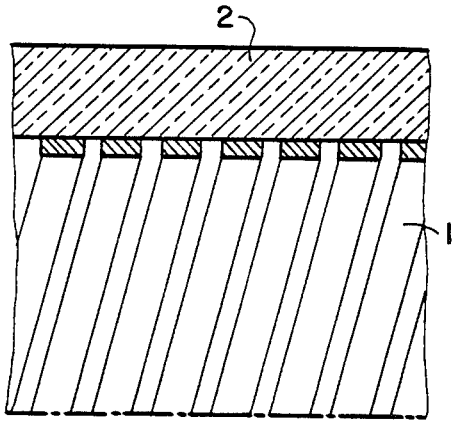
Figure 5:
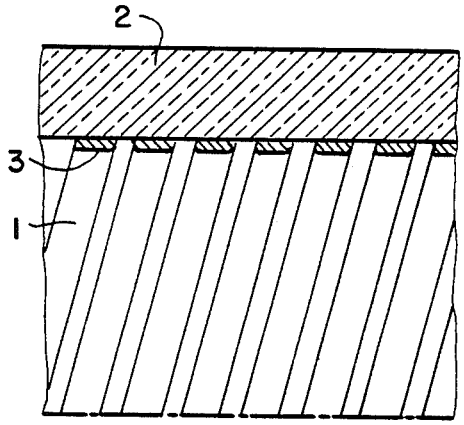
Figure 6:
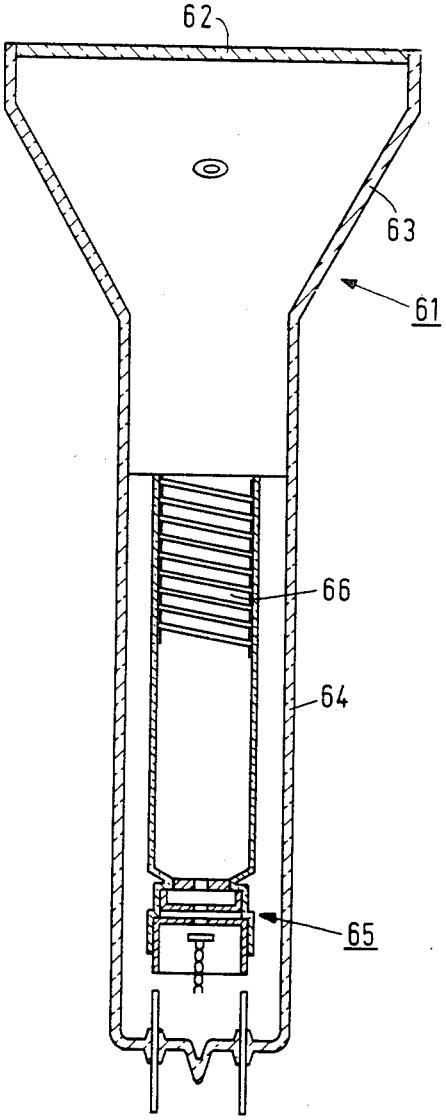
Figure 7:
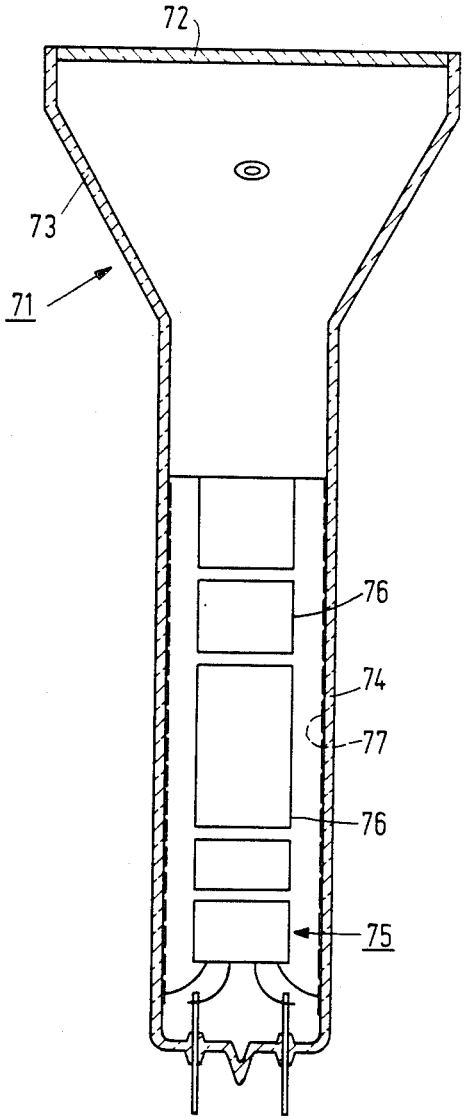
Figure 8:
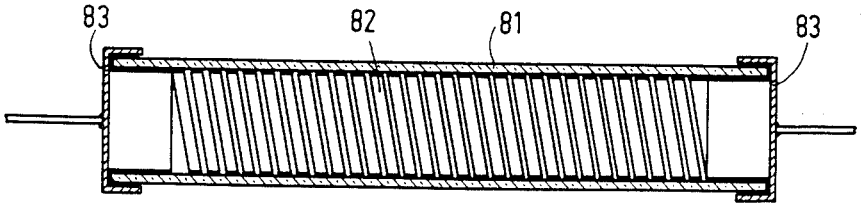

The invention will now be described in greater detail with reference to a few embodiments and the accompanying drawings, in which FIG. 1 shows the relationship between the resistivity $\rho$ in ohm. cm. and the heating temperature T in °C. at a given heating time of resistance layers having a given composition obtained by means of the method according to the invention FIG. 2 shows the relationship between the resistivity $\rho$ in ohm. cm. and the heating time t in minutes at a given heating temperature of resistance layers having the same composition as the layers of FIG. 1 obtained by means of the method according to the invention, FIG. 3 shows the relationship between the resistivity $\rho$ in ohm.cm. and the heating time t in minutes at the same heating temperature of resistance layers having composition differing from that of the layers of FIGS. 1 and 2, obtained by means of the method according to the invention, FIGS. 4 and 5 show diagrammatically, partly as an elevation and partly as a cross-sectional view, a device in successive stages of the manufacture by means of the method according to the invention, FIG. 6 is a diagrammatic sectional view of a part of a cathode ray tube obtained by using the method according to the invention, FIG. 7 is a diagrammatic sectional view of a part of another cathode ray tube obtained by using the method according to the invention, FIG. 8 is a diagrammatic sectional view of a part of a resistor obtained by using the method according to the invention.

In the manufacture of a device a homogeneous electric resistance layer 1 (FIG. 4) of resistance material having a resistivity of at least 10 ohm.cm. is formed on an insulating substrate 2.

In order to obtain reproducible and homogeneous electrical resistance layers of high resistivity on insulating substrates, according to the invention a layer is provided on the insulating substrate 2 from a stable binder-free suspension comprising ruthenium hydroxide and glass particles, from which an electric resistance layer 1, which contains 1–6% by weight of ruthenium oxide is formed by heating.

The glass enamel preferably has substantially the same coefficient of thermal expansion as the substrate material and a lower softening point. In the case that the invention is applied to a display tube, the substrate material may be a lead glass, e.g. a lead glass of the type containing 62.4% by weight of $SiO_2$,21% by weight of PbO, 7.3% by weight of $K_2O$, 6.8% by weight of $Na_2O$, 1.3% by weight of $Al_2O_3$ and further some minor constituents. The softening point of this particular glass is 640° C. A suitable glass enamel then is a lead-borate glass containing 80% by weight of PbO, 16% by weight of $B_2O_3$ and 4% by weight of ZnO, the softening point of which is 400° C. Other suitable glass enamels are the 187 type, which contains 77.2% by weight of PbO, 13.3% by weight of $B_2O_{3,5.5}$% by weight of $Al_2O_{3,2}$% by weight of ZnO and some minor constituents (softening point 415° C.), and the 215 type, which contains 68.1% by weight of PbO, 17.9% by weight of $B_2O_{3,8}$% by weight of ZnO, 3% by weight of $Al_2O_3$ and 3% by weight of $SiO_2$ (softening point 454° C.)

A sufficiently viscous suspension may be obtained by first mixing glass enamel powder in a beaker glass with water. Ruthenium chloride ($RuCl_3$) is dissolved in water and added to the mixture. Ruthenium hydroxide is deposited in the mixture by the addition of ammonia.

The mixture is then allowed to settle after which the water is siphoned off and the precipitate is dried.

The dried precipitate is placed in a ball mill and isopropanol and ammonia are added. Grinding is then carried out for approximately 140 hours so as to obtain a good mixing and to pulverize possibly coarse particles.

By means of the stable suspension thus obtained, glass surfaces can be coated with a very uniform resistance powder layer. The electrical resistance layer is formed from the powder layer by heating.

The resulting resistance depends on the layer thickness, on the percentage of ruthenium oxide, on the firing temperature and on the firing time. Below 1% by weight of ruthenium oxide the layer is not sufficiently electrically conductive. Above 6% by weight the resistance is too low.

In FIG. 1 the ruthenium oxide percentage in the resistance layers is 3% by weight and heating is carried out for 10 minutes.

In FIG. 2 the ruthenium oxide percentage in the resistance layers is also 3% by weight and heating is carried out at 500° C.

In FIG. 3 the ruthenium oxide percentage in the resistance layers is 2% by weight and the heating temperature is 500° C. The thickness of the electrical resistance layer may be, for example, 1 to 1.5/$\mu$m.

In practice it has been found to be very simple to obtain a given desired resistance value by using at a given heating temperature the heating time corresponding to the desired resistance value.

It is possible to give that layer special shapes. A shaping treatment is carried out after providing the layer on the insulating substrate and prior to heating the layer. A mechanical shaping treatment may advantageously be used.

For example, as shown in FIG. 4, a layer 1 is provided from a suspension on the inside of a hollow glass tube 2, for example, by drawing-in the suspension into the tube 2 to a desired height and then draining, after which the layer on the inside of the hollow tube 2 is given a helical shape by scratching.

After heating, the helically coiled resistance layer produced has finely rounded off winding turns 3 (see FIG. 5). The flash-over voltage between adjacent turns is found to be very high. The spacing between the winding turns is, for example, 50 μm and the pitch of the winding turns 300 μm.

Such a helically coiled resistance layer may serve as a voltage divider in a cathode ray tube, for example, by varying the pitch, by varying the spacing between the turns, or by varying the resistance.

The frequently used focussing lenses have a comparatively large diameter of which only the central part is used to avoid spherical aberration. When the helically coiled resistance layer obtained by means of the method according to the invention is used as a focussing lens, a tube may be used whose gun and neck diameters are much smaller and the focussing lens of which has the same voltage distribution as the central part of a conventional lens with large diameter and hence has a small spherical aberration.

This is the case in a cathode ray tube according to the invention (see FIG. 6). It comprises a glass envelope 61 which consists of a display window 62, a cone 63 and a neck 64. An electron gun 65 having a coiled focussing electrode 66 is present in the neck. Said coiled focussing electrode is obtained as described above by means of the method according to the invention. Herewith the voltage distribution desired for focussing can be obtained.

The resistance layer obtained by means of the method according to the invention may also be used, whether or not as a coil, as an anti-charging layer to prevent too high a potential in the neck of a cathode ray tube.

In this case (see FIG. 7) a cathode ray tube comprises a glass envelope 71 consisting of a display window 72, a cone 73 and a neck 74, an electron gun 75 having focussing electrodes 76 being provided in the neck. An anti charging layer 77, for example, in the form of a helically coiled resistance layer obtained by means of the method according to the invention as described above is present on the inner wall of the neck 74.

In another application of the method according to the invention a high-ohmic resistor for use at high voltage is obtained in which a helically coiled resistance layer 82 is provided on a suitable insulating ceramic substrate or in a glass tube 81 (see FIG. 8) by means of the method according to the invention as described herein before.

The resistor is provided in the conventional manner with metal contacts 83.

Of course the invention is not restricted to the examples described. For example, the coiled resistance layer as described may also be used for converging 3 electron beams in colour television display tubes (Netherlands Patent Application No. 8400779).

It will be obvious to those skilled in the art that many variations are possible without departing from the scope of this invention.

What is claimed is:

1. A method of manufacturing a device in which a homogeneous electrical resistance layer of a resistive material having a resistivity of at least 10 ohm. cm is formed on an insulating substrate, characterized in that from a stable binder-free suspension containing ruthenium hydroxide and glass particles a layer is provided on the insulating substrate from which an electrical resistance layer, which contains 1–6 percent by weight of ruthenium oxide, is formed by heating.

2. A method as claimed in claim 1, characterized in that the suspension is made by providing a mixture of glass particles and water, in which mixture ruthenium hydroxide is precipitated.

3. A method as claimed in claim 2, characterized in that the precipitate of ruthenium hydroxide and glass particles is suspended in an alcohol to which ammonia is added.

4. A method as claimed in claim 3, characterized in that isopropanol is used as an alcohol.

5. A method as claimed in claim 1, characterized in that after providing the layer from the suspension on the insulating substrate and prior to the heating the layer is subjected to a shaping treatment.

6. A method as claimed in claim 5, characterized in that a mechanical shaping treatment is used.

7. A method as claimed in claim 6, characterized in that the layer on the inside of the hollow tube is given a helical form mechanically.

8. A method as claimed in claim 1, characterized in that the layer is provided from the suspension on the inside of a hollow tube as the insulating substrate.

9. A method as claimed in claim 8, characterized in that the layer is provided from the suspension by drawing-in the suspension into the tube to a desired height and then draining the suspension from the tube.

10. A cathode ray tube comprising a glass envelope consisting of a display window, a cone and a neck, and an electron gun having at least one focusing electrode provided in said neck, characterized in that the focusing electrode is a helically coiled resistance layer which layer is provided in said neck from a suspension, in accordance with the method of claim 7, and is given a helical form mechanically.

* * * * *